US012305947B2

(12) United States Patent
Gerber

(10) Patent No.: US 12,305,947 B2
(45) Date of Patent: May 20, 2025

(54) OFF-TRIGGER FINGER REST FOR FIREARMS

(71) Applicant: Scott Gerber, Ham Lake, MN (US)

(72) Inventor: Scott Gerber, Ham Lake, MN (US)

( * ) Notice: Subject to any disclaimer, the term of this patent is extended or adjusted under 35 U.S.C. 154(b) by 0 days.

(21) Appl. No.: 18/477,390

(22) Filed: Sep. 28, 2023

(65) Prior Publication Data

US 2024/0110761 A1 Apr. 4, 2024

Related U.S. Application Data

(60) Provisional application No. 63/377,902, filed on Sep. 30, 2022.

(51) Int. Cl.
*F41A 33/00* (2006.01)
*F41C 23/10* (2006.01)

(52) U.S. Cl.
CPC ..... *F41A 33/00* (2013.01); *F41C 23/10* (2013.01)

(58) Field of Classification Search
None
See application file for complete search history.

(56) References Cited

U.S. PATENT DOCUMENTS 2,270,707 A * 1/1942 Humski ..... F41G 1/00 42/59
2,109,993 A * 3/1945 Furst ..... F41G 1/00 33/262
D142,016 S * 8/1945 Birk ..... D22/104
5,239,767 A * 8/1993 Briley, Jr. ..... F41A 17/44 42/70.11
5,560,133 A * 10/1996 Kuebler ..... F41C 23/00 42/69.01
6,775,940 B2 * 8/2004 Dworzan ..... F41A 9/53 42/106
6,876,756 B1 * 4/2005 Vieweg ..... G07C 9/37 361/732
D604,794 S * 11/2009 Bentley ..... F41C 23/10 D22/109
7,661,219 B1 * 2/2010 Knight, Jr. ..... F41A 3/42 89/138
D658,263 S * 4/2012 Nierenberg ..... D22/104
8,281,512 B2 * 10/2012 Lara ..... F41C 33/041 224/198
RE44,786 E * 3/2014 Hudson ..... F41A 17/06 434/21
8,671,605 B2 * 3/2014 Siddle ..... F41C 23/10 42/106

(Continued)

*Primary Examiner* — Derrick R Morgan
(74) *Attorney, Agent, or Firm* — Squire Patent Consulting & IP Law LLC; Brendan E. Squire

(57) ABSTRACT

An off-trigger safety training device for firearms and method of use. The off-trigger safety training device is removably attached to a firearm proximal to a trigger of the firearm. The off-trigger safety training device is positioned for longitudinal alignment with a barrel of the firearm and includes a concave recess oriented in alignment with the barrel of the firearm for receiving the operator's trigger finger. Longitudinally extending ribs protrude from a face of the concave recess permit the user to align their finger within the concave recess and receive a complementary longitudinal tactile engagement with the ribs for positive engagement of the trigger finger with the off-trigger safety training device.

14 Claims, 2 Drawing Sheets

(56) References Cited

U.S. PATENT DOCUMENTS 8,713,831 B2 * 5/2014 Grossman ..... F41C 23/10 42/106
8,782,937 B2 * 7/2014 Grossman ..... F41A 17/46 42/70.01
D755,327 S * 5/2016 Siddle ..... D22/108
10,690,426 B1 * 6/2020 Huang ..... F41A 9/59
D1,029,172 S * 5/2024 Alson ..... D22/108
2004/0216348 A1 * 11/2004 McMoore ..... F41A 17/46 42/70.07
2005/0099389 A1 * 5/2005 Ma ..... A63F 13/245 345/158
2011/0107642 A1 * 5/2011 Godard ..... F41C 23/16 156/60
2011/0138667 A1 * 6/2011 Bolden ..... F41C 27/00 42/1.01
2012/0141957 A1 * 6/2012 Miller ..... F41G 3/26 434/16
2014/0047748 A1 * 2/2014 Grossman ..... F41A 17/46 42/1.01
2014/0047749 A1 * 2/2014 Grossman ..... F41C 23/14 42/1.01
2014/0047750 A1 * 2/2014 Siddle ..... F41C 27/00 29/428
2016/0069637 A1 * 3/2016 Kafer ..... F41C 23/16 42/49.01
2017/0176137 A1 * 6/2017 Ortiz ..... F41C 33/001
2017/0227312 A1 * 8/2017 Christensen ..... F41A 9/66
2021/0231397 A1 * 7/2021 Baskett ..... F41C 3/14
2021/0364248 A1 * 11/2021 Teague ..... F41C 23/12
2021/0389067 A1 * 12/2021 Alson ..... F41A 9/59
2023/0013901 A1 * 1/2023 Strayer ..... F41C 23/06
2023/0075844 A1 * 3/2023 Chandler ..... F41A 17/066
2023/0168067 A1 * 6/2023 Ross ..... H04W 4/10 42/146

* cited by examiner

OFF-TRIGGER FINGER REST FOR FIREARMS

CROSS-REFERENCE TO RELATED APPLICATION

This application claims the benefit of priority of U.S. provisional application No. 63/377,902, filed Sep. 30, 2022, the contents of which are herein incorporated by reference.

BACKGROUND OF THE INVENTION

The present invention relates to firearms and, more particularly to off-trigger safety devices for firearms.

Off-trigger safety devices for firearms provide firearms operators a muscle memory training device for the positioning of the operator's trigger finger in a safe, off-trigger location when handling the firearm.

Other off-trigger safety devices rely on longitudinally aligned protrusions to adapt the user to the position of the device rather than positioning the device based on the location of the user's trigger finger when grasping the firearm. These devices do not provide complementing tactile references for the position and orientation of the user's trigger finger.

As can be seen, there is a need for an improved off-trigger safety training device.

SUMMARY OF THE INVENTION

In some aspects of the invention, an off-trigger finger rest for a firearm is disclosed. The off-trigger finger rest for a firearm, includes a plate having a front surface and a back surface. A concave recess is defined in the front surface and extends laterally across a longitudinal length of the plate. A plurality of rib protrusions are disposed in a spaced apart relation from one another along a vertical centerline of the plate.

In some embodiments, an adhesive is applied to the back surface of the plate. The adhesive is adapted to attach the off-trigger finger rest with a frame of the firearm.

In some embodiments, the concave recess has a radius of curvature adapted to receive a tip of a trigger finger of the user.

In some embodiments, the plurality of rib protrusions are offset from a longitudinal centerline and extend across a nadir of the concave recess.

In some embodiments, a ridge is disposed at a top end and a bottom end of the plate at ends of the concave recess. The ridge may have a flattened surface.

In other aspects of the invention, an off-trigger finger rest is disclosed. The off-trigger finger rest having a concave recess defined in a front surface of a plate. The concave recess extends laterally across the front surface. A plurality of rib protrusions are disposed in a spaced apart relation from one another. The plurality of rib protrusions extend laterally across the concave recess. A ridge is provided at a top end and a bottom end of the plate at opposed ends of the concave recess. Each of the concave recess, the plurality of rib protrusions, and the ridge provide complementary tactile feedback for positioning of a user's trigger finger.

In some embodiments, an attachment is provided on a back surface of the plate. The attachment is adapted to secure the trigger finger rest to a frame of a firearm. Preferably, the attachment is an adhesive.

In some embodiments, a nadir in the concave recess is disposed between the plurality of rib protrusions.

In other aspects of the invention, a method of fitting a firearm with an off-trigger finger rest is disclosed. The method includes providing an off-trigger finger rest formed as a plate having a concave recess defined in a front surface of the plate. A plurality of protruding ribs are disposed in a spaced apart relation and extend laterally across the concave recess. The concave recess and the plurality of protruding ribs provide a first and a second complementary tactile feedback for an operator of the firearm. A back surface of the plate is positioned in abutment with a rail of the firearm at an off-trigger location of a fingertip of a user's trigger finger, while holding a grip of the firearm. The off-trigger location is marked on the frame of the firearm.

In some embodiments, the method includes applying an adhesive to the back surface of the off-trigger finger rest and adhering the off-trigger finger rest to the off-trigger location.

In other embodiments, the method includes providing a ridge disposed across a top end and a bottom end of the front surface of the plate, the ridge providing a third complementary tactile feedback for the operator of the firearm.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Broadly, an embodiment of the present invention provides an improved off-trigger training device for developing proper trigger finger discipline in the handling and operation of a firearm. The off-trigger training device provides an off-trigger finger rest that develops proper muscle memory for the operator of a firearm to position their trigger finger in a safe position, off the trigger of the firearm, until the operator is ready to fire the firearm.

While it sounds easy to do, "trigger finger discipline" may be one of the more difficult firearm safety rules to make a habit. The problem arises because of the operator's natural tendency to grip the trigger of the firearm when their other three fingers grasp the grip of the firearm. The natural tendency of the operator's trigger finger to grasp the trigger may be overcome by proper training and the training device of the present invention is provided to teach the operator proper "trigger finger discipline." The off-trigger training device may also be utilized as a trigger finger rest.

The off-trigger finger rest allows the operator to learn not to grasp the trigger with the trigger finger, but rather, to leave it in an extended position until ready to fire. To learn this skill and train effectively the off-trigger finger rest provides a tactile feedback to the operator at a location to accommodate an extended trigger finger at an off-trigger position. After much practice and development of the muscle memory, the off-trigger positioning of the operator's trigger finger will become more natural. In fact, after an effective training period, the operator will notice that they will automatically extend their index finger to the off-trigger position all the time.

Figure 1:
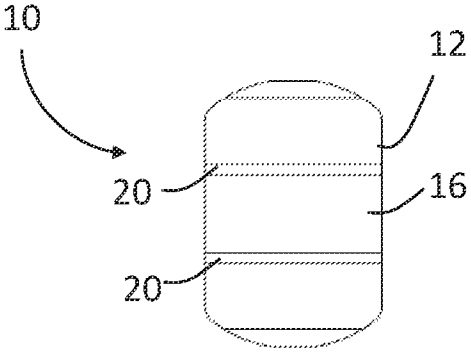
FIG. 1 is a front elevation view of the off-trigger finger rest.
Figure 2:
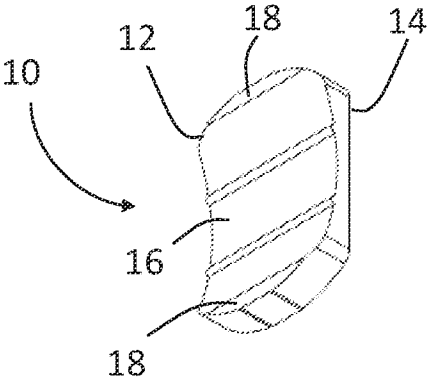
FIG. 2 is a front perspective view of the off-trigger finger rest.
Figure 3:
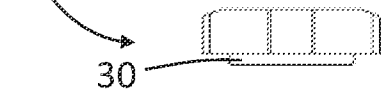
FIG. 3 is a top plan view of the off-trigger finger rest, the bottom plan view being a mirror image thereof.
Figure 4:
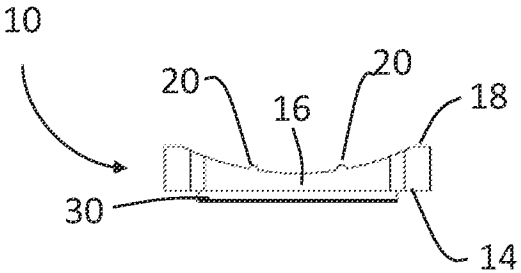
FIG. 4 is a left side elevation view of the off-trigger finger rest, the right side elevation view being a mirror image thereof.
Figure 5:
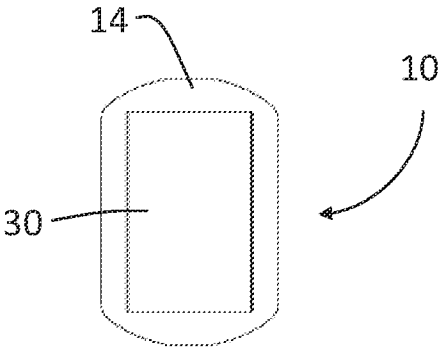
FIG. 5 is a back elevation view of the off-trigger finger rest.
Figure 6:
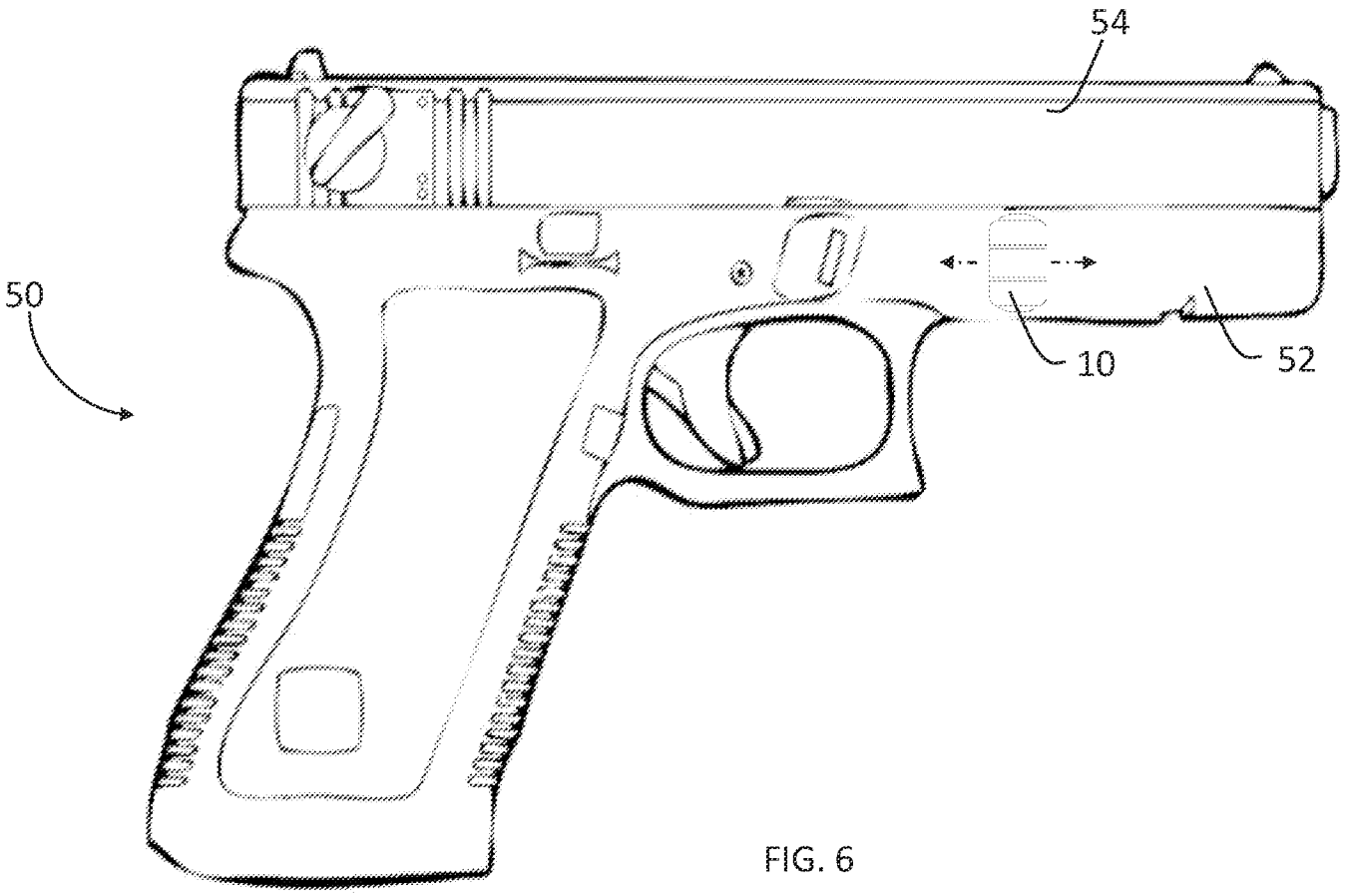
FIG. 6 illustrates a side elevation view of a firearm with the off-trigger training device mounted to a frame of the firearm.

Firearms have no dedicated off-trigger location for positioning the user's trigger finger as built. Typically, a device must be added to the firearm to provide a dedicated tactile location for the user's trigger finger. As seen in reference to the drawings of FIGS. 1-6, the off-trigger training device 10 is formed as an plate having a front surface 12 and a back surface 14. The front surface 12 has a concave recess 16 extending laterally across a longitudinal length of the arcuate plate. The concave recess 16 has a radius of curvature dimensioned to receive a tip of a trigger finger of a user. The radius of curvature is approximately 0.75".

Top and bottom ends of the plate have an arcuate shape. A top and a bottom ridge 18 extend across a top edge and a bottom edge of the off-trigger finger rest 10 at ends of the concave recess 16. The top and the bottom ridges 18 have a flattened top surface and abrupt side edges to allow the operator to positively determine the position of their finger with the finger rest 10, and then position a tip of their trigger finger within the concave recess 16.

A plurality of rib protrusions 20 are disposed in a vertically offset relation from one another along a vertical centerline of the arcuate plate. Preferably, the plurality of rib protrusions 20 are offset from a longitudinal centerline extending across a nadir of the concave recess 16, such that the center of the operator's trigger finger is positioned in the nadir between two adjacent rib protrusions 20 with the off-trigger finger rest 10 mounted to a firearm 50. The plurality of rib protrusions 20 are disposed as longitudinal ridges extending across the face of the concave recess 16. The combination of the rib protrusions 20 and the nadir of the concave recess 16 provide complementary tactile alignment reference points for off-trigger positioning and alignment of the operator's trigger finger with the frame 52 of the firearm 50. Advantageously, each of the concave recess 16, the top and bottom ridges 18, and the rib protrusions 20, provide complementing tactile positioning references to allow the user to position their finger along the frame 52 without positioning their trigger finger on the slide 54 of the firearm 50. As will be appreciated from the present disclosure, the off-trigger finger rest 10 may also be mounted to a stock of a long gun forward of the trigger guard.

The off-trigger training device 10 may be removably mounted to the firearm 50 with an attachment 30, such as an adhesive, a magnet, a weld, or a screw. Preferably, the adhesive 30 is a very high bond double sided tape with a release liner.

To use the off-trigger training device 10, the user would clean the firearm 50 with a suitable cleaner or solvent, such as isopropyl alcohol, to remove any oils and dirt, so that a strong adhesive bond may be obtained. The operator would "dry fit" the off-trigger training device 10 by grasping the butt or hand grip of the firearm 50 and extend their trigger finger along the frame 52 of the firearm 50, marking the location for mounting the off-trigger training device 10. Once a desired position is marked. Peel back the adhesive liner (preferred) and attach the off-trigger training device 10 to the firearm 50 with the application of a light pressure. Grip the firearm 50 to ensure proper location and positioning of the concave recess 16 of the off-trigger safety device 10 in a unique and specific location for each user.

The off-trigger training device 10 could be used on other triggered devices like crossbows.

It should be understood, of course, that the foregoing relates to exemplary embodiments of the invention and that modifications may be made without departing from the spirit and scope of the invention as set forth in the following claims.

What is claimed is:

1. An off-trigger finger rest for a firearm, comprising:

a plate having a front surface and a back surface;

the back surface of the plate is adapted to attach the off-trigger finger rest with a frame of the firearm;

a concave recess defined in the front surface extending laterally across a longitudinal length of the plate, the concave recess having a nadir at a vertical midpoint of the plate, the concave recess dimensioned to receive a tip of a trigger finger of an operator's firing hand;

and a single pair of rib protrusions disposed as ridges extending across the front surface of the concave recess in a spaced apart relation from one another about the nadir, wherein the nadir of the concave recess and the pair of rib protrusions are adapted to provide a complementary tactile alignment reference point for the off-trigger finger rest for positioning and alignment of the trigger finger spaced apart from a grip of the firearm.

2. The off-trigger finger rest of claim 1, further comprising:

an adhesive applied to the back surface of the plate, the adhesive adapted to attach the off-trigger finger rest with a frame of the firearm.

3. The off-trigger finger rest of claim 1, wherein the concave recess has a radius of curvature adapted to receive a tip of a trigger finger of a user.

4. The off-trigger finger rest of claim 1, wherein the plurality of rib protrusions are offset from a longitudinal centerline extending across a nadir of the concave recess.

5. The off-trigger finger rest of claim 1, further comprising:

a ridge disposed at a top end and a bottom end of the plate at ends of the concave recess.

6. The off-trigger finger rest of claim 5, wherein the ridge has a flattened surface.

7. An off-trigger finger rest for a firearm, comprising:

a plate having a front surface, a back surface, and a height dimensioned to correspond with a frame of the firearm;

the back surface of the plate is adapted to attach the off-trigger finger rest with the frame of the firearm;

a concave recess defined in a front surface of plate, the concave recess having a nadir at a vertical midpoint of the plate extending laterally across the front surface, the concave recess dimensioned to receive a tip of a trigger finger of an operator and;

a single pair of rib protrusions disposed in a spaced apart relation from one another about the nadir, the plurality of rib protrusions extending laterally across the concave recess; and a ridge at a top end and a bottom end of the plate at opposed ends of the concave recess, wherein each of the concave recess, the single pair of rib protrusions, and the ridge a complementary tactile feedback for an off-trigger positioning of the trigger finger.

8. The off-trigger finger rest of claim 7, further comprising:

an attachment on the back surface of the plate adapted to secure the off-trigger finger rest to the frame of a firearm.

9. The off-trigger finger rest of claim 8, wherein the attachment is an adhesive.

10. The off-trigger finger rest of claim 7, further comprising:

a nadir in the concave recess disposed between the plurality of rib protrusions.

11. A method of fitting a firearm with an off-trigger finger rest, comprising:

providing an off-trigger finger rest formed as a plate having a concave recess defined in a front surface of the plate, and a single pair of protruding ribs disposed in a spaced apart relation and extending laterally across the concave recess, the concave recess and the single pair of protruding ribs dimensioned to receive a tip of an operator's trigger finger providing a first and a second complementary tactile feedback for an operator of the firearm when the tip of the operator's trigger finger is received in the concave recess and disposed between the single pair of protruding ribs;

positioning a back surface of the plate in abutment with a frame of the firearm at an off-trigger location of a finger tip of a user's trigger finger, while holding a grip of the firearm; and marking the off-trigger location on the frame of the firearm.

12. The method of claim 11, further comprising:

applying an adhesive to the back surface of the off-trigger finger rest.

13. The method of claim 12, further comprising:

adhering the off-trigger finger rest to the off-trigger location.

14. The method of claim 13, further comprising:

providing a ridge disposed across a top end and a bottom end of the front surface of the plate, the ridge providing a third complementary tactile feedback for the operator of the firearm.

* * * * *